US008736528B2

(12) United States Patent
Choi

(10) Patent No.: US 8,736,528 B2
(45) Date of Patent: May 27, 2014

(54) LIQUID CRYSTAL DISPLAY AND METHOD OF DRIVING THE SAME INCLUDING PROVIDING DIFFERENT DITHERING PATTERNS TO ADJACENT DISPLAY REGIONS

(75) Inventor: Yun-Seok Choi, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 737 days.

(21) Appl. No.: 12/469,802

(22) Filed: May 21, 2009

(65) Prior Publication Data

US 2009/0289883 A1 Nov. 26, 2009

(30) Foreign Application Priority Data

May 21, 2008 (KR) ..... 10-2008-0047216

(51) Int. Cl.
*G09G 3/36* (2006.01)

(52) U.S. Cl.
USPC ..... 345/89; 345/596; 345/599

(58) Field of Classification Search
USPC ..... 345/596–599; 348/574; 358/457
See application file for complete search history.

(56) References Cited

U.S. PATENT DOCUMENTS

| | | | | | |
|---|---|---|---|---|---|
| 5,179,640 | A * | 1/1993 | Duffy | 345/596 |
| 6,141,121 | A * | 10/2000 | Chen et al. | 358/534 |
| RE36,948 | E * | 11/2000 | McDonough et al. | 400/124.01 |
| 7,126,611 | B1 * | 10/2006 | Weed | 345/589 |
| 2006/0221401 | A1 * | 10/2006 | Daly et al. | 358/3.13 |
| 2008/0186325 | A1 * | 8/2008 | Higgins et al. | 345/592 |
| 2008/0238911 | A1 * | 10/2008 | Chung et al. | 345/214 |

FOREIGN PATENT DOCUMENTS

| | | | | |
|---|---|---|---|---|
| JP | 2002196730 | | 7/2002 | |
| KR | 1020060092668 | A | 8/2006 | |
| KR | 1020060092668 | A * | 8/2006 | G02F 1/133 |
| KR | 1020080001598 | A | 1/2008 | |

* cited by examiner

*Primary Examiner* — Kwang-Su Yang
(74) *Attorney, Agent, or Firm* — F. Chau & Associates, LLC

(57) ABSTRACT

A liquid crystal display (LCD) and a method of driving the LCD in which the LCD includes a liquid crystal panel divided into a plurality of display regions, each of the display regions having a plurality of pixels; and a timing controller receiving a primitive image signal for displaying an image in the display regions, and correcting the primitive image signal using a plurality of dithering patterns respectively corresponding to the display regions, wherein the display regions in contact with each other on at least one side correspond to different dithering patterns.

12 Claims, 7 Drawing Sheets

LIQUID CRYSTAL DISPLAY AND METHOD OF DRIVING THE SAME INCLUDING PROVIDING DIFFERENT DITHERING PATTERNS TO ADJACENT DISPLAY REGIONS

CROSS-REFERENCE TO RELATED APPLICATION

This application claims priority from Korean Patent Application No. 10-2008-0047216 filed on May 21, 2008 in the Korean Intellectual Property Office, the disclosure of which is incorporated herein by reference in its entirety.

BACKGROUND OF THE INVENTION

1. Technical Field

The present disclosure relates to a liquid crystal display (LCD) and a method of driving the LCD.

2. Discussion of Related Art

Liquid crystal displays (LCDs) generally include a first display panel having a plurality of pixel electrodes, a second display panel, a dielectric-anisotropy liquid crystal layer interposed between the first and second display panels, a gate driver driving a plurality of gate lines, a data driver driving a plurality of data lines, and a timing controller controlling the gate driver and the data driver.

The timing controller, gate driver and data driver of an LCD appropriately process an image signal provided by an external source and provide the processed image signal to the liquid crystal panel, thereby displaying an image. The timing controller may perform dithering of a primitive image signal in order to display various grayscale levels.

SUMMARY OF THE INVENTION

In order to perform dithering on an image signal, the same dithering patterns may be applied to each frame. Even if dithered pixels are evenly distributed in each dithering pattern, however, the number of pixels dithered per frame may vary due to an interval between dithering patterns. Thus, horizontal or vertical stripes may appear on a liquid crystal panel, or flickering may occur.

Exemplary embodiments of the present invention provide a liquid crystal display (LCD) that can improve the quality of display.

Exemplary embodiments of the present invention also provide a method of driving an LCD that can improve the quality of display.

The aspects, features and advantages of the exemplary embodiments of the present invention are not restricted to the ones set forth herein. The above and other aspects, features and advantages of the exemplary embodiments of the present invention will become more apparent to one of ordinary skill in the art to which the present invention pertains by referencing a detailed description of the exemplary embodiments of the present invention given below.

According to an exemplary embodiment of the present invention, there is provided an LCD including: a liquid crystal panel divided into a plurality of display regions, each of the display regions having a plurality of pixels; and a timing controller receiving a primitive image signal for displaying an image in the display regions, and correcting the primitive image signal using a plurality of dithering patterns respectively corresponding to the display regions, wherein the display regions contacting with each other by at least one side correspond to different dithering patterns.

As used herein, dithering of image data means that a predetermined compensation value is applied. That is, if the gray scale value of the primitive image signal corresponding to an arbitrary display region is "Y" which is A bits (A is a natural number), the image signal corresponding to the display region is revised to "X" and "X+1" which are B bits. (B is a natural number, less than A). And "X+1" is higher than "X" by one gray scale in the dithered image data. This means that by using the combination "X and X+1", the LCD displays an image corresponding to the primitive image signal "Y".

According to an exemplary embodiment of the present invention, there is provided an LCD including: a liquid crystal panel divided into a plurality of display regions that are arranged in a matrix having "a" rows and "b" columns (where a and b are natural numbers), wherein each row of the plurality of display region comprises 'n' display regions (where n is natural number) that are sequentially arranged in a first through n-th display region sequence; and a timing controller receiving a primitive image signal for displaying an image in the display regions, and correcting the primitive image signal using a plurality of dithering patterns respectively corresponding to the display regions, wherein the timing controller sequentially determines dithering patterns respectively corresponding to first through n-h display regions, and a dithering pattern corresponding to a k-th display region (where k is between 2 and n) in each of the 'a' rows is different from a dithering pattern corresponding to a (k−1)-th display region.

According to an exemplary embodiment of the present invention, there is provided a method of driving an LCD, the method including: providing a liquid crystal panel divided into a plurality of display regions, each of the display regions having a plurality of pixels; receiving a primitive image signal for displaying an image in the display regions; and correcting the primitive image signal using a plurality of dithering patterns respectively corresponding to the display regions, wherein the display regions contacting with each other by at least one side correspond to different dithering patterns.

BRIEF DESCRIPTION OF THE DRAWINGS

Exemplary embodiments of the present invention will be understood in more detail from the following descriptions taken in conjunction with the attached drawings, in which.

DETAILED DESCRIPTION OF EXEMPLARY EMBODIMENTS

The present invention will now be described more fully with reference to the accompanying drawings, in which exemplary embodiments of the invention are shown. The invention may, however, be embodied in many different forms and should not be construed as being limited to the exemplary embodiments set forth herein. Rather, these exemplary embodiments are provided so that this disclosure will be thorough and complete, and will fully convey the concept of the invention to those of ordinary skill in the art.

Figure 1:
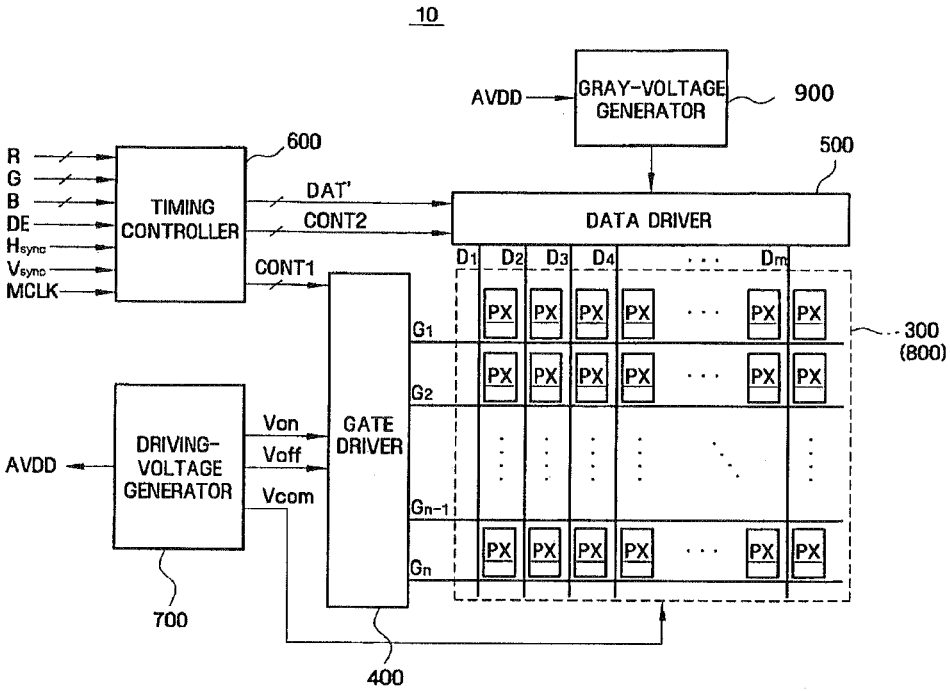
FIG. 1 is a block diagram of a liquid crystal display (LCD) according to an exemplary embodiment of the present invention.
Figure 2:
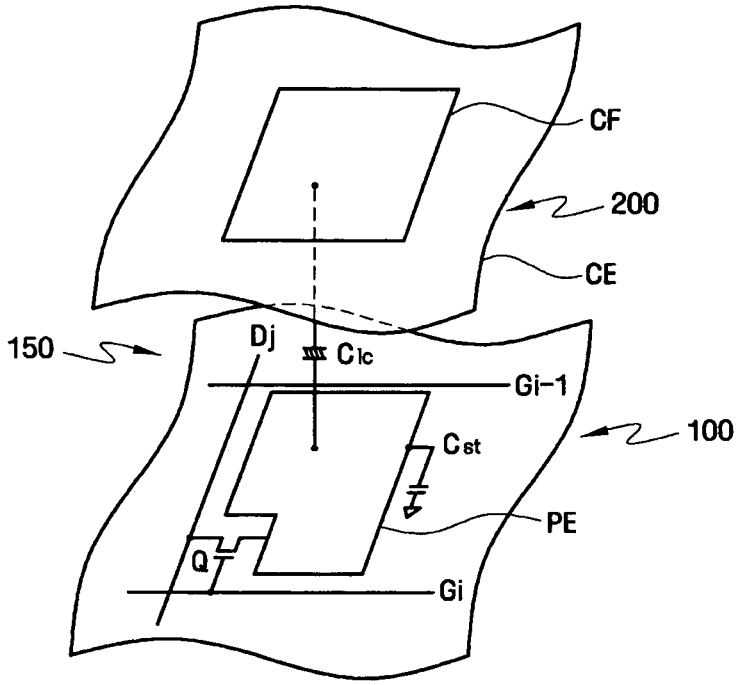
FIG. 2 is an equivalent circuit diagram of a pixel of the LCD shown in FIG. 1.
Figure 3:
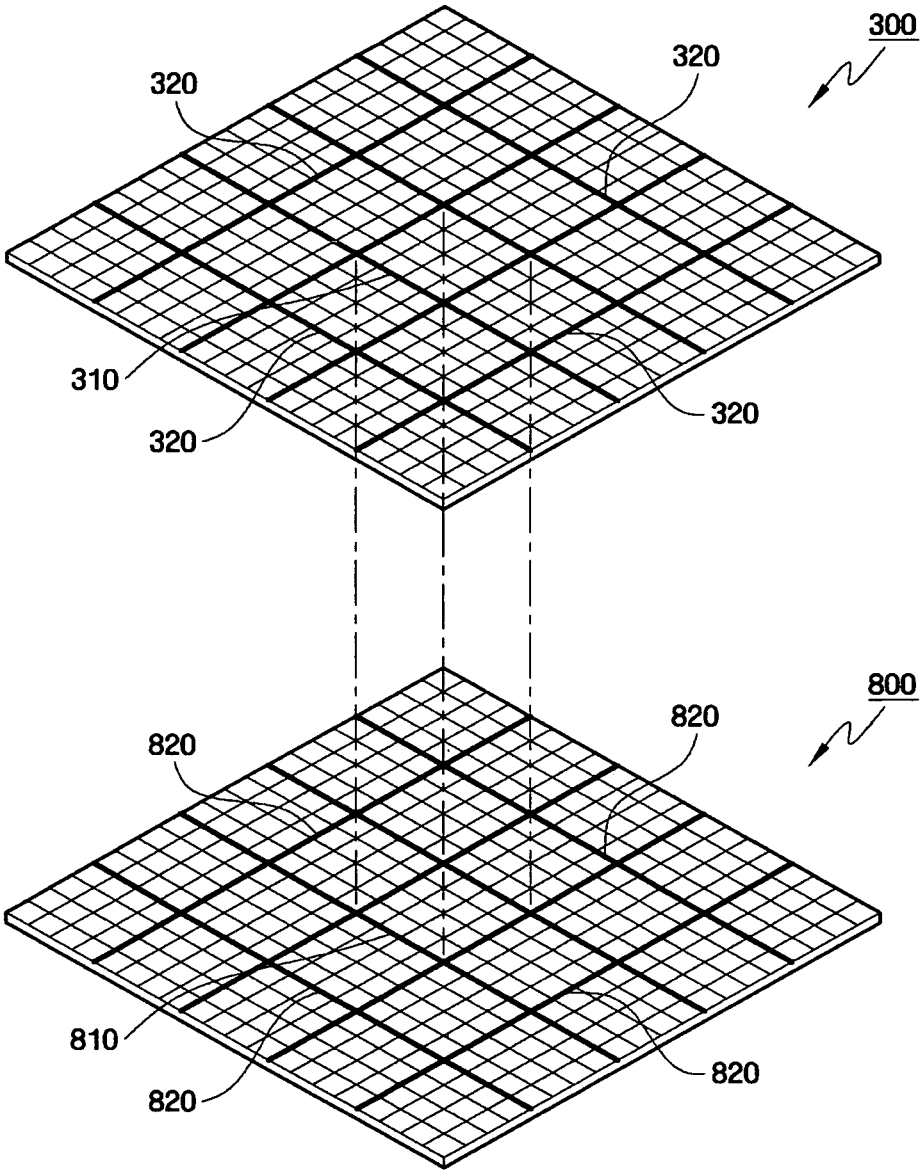
FIG. 3 is a diagram for explaining the correspondence between a liquid crystal panel shown in FIG. 1 and a dithering pattern array.
Figure 4:
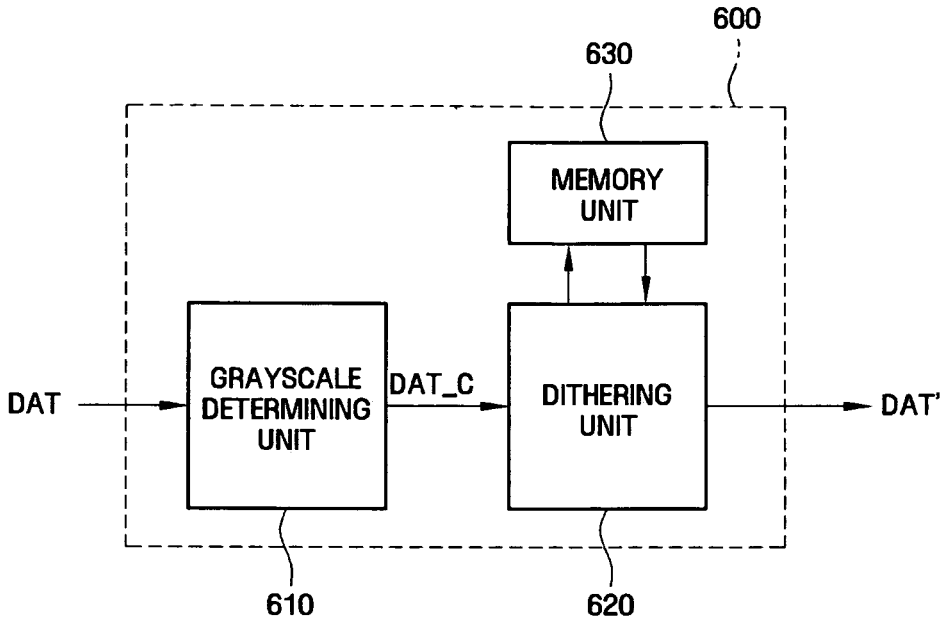
FIG. 4 is a block diagram of a timing controller shown in FIG. 1.
Figure 5:
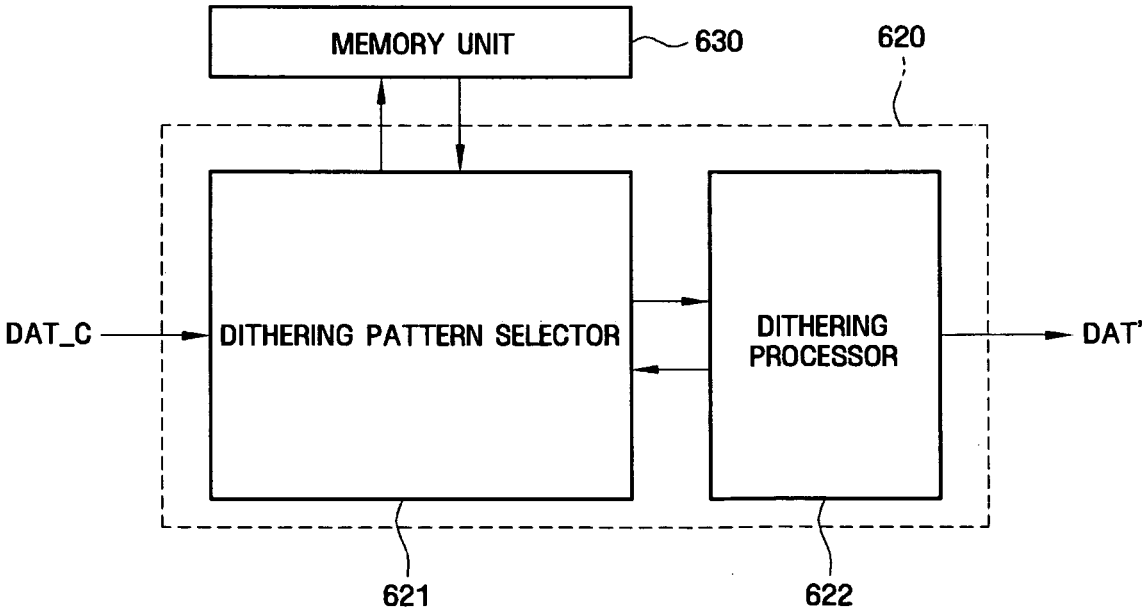
FIG. 5 is a block diagram of a dithering unit shown in FIG. 4.
Figure 6:
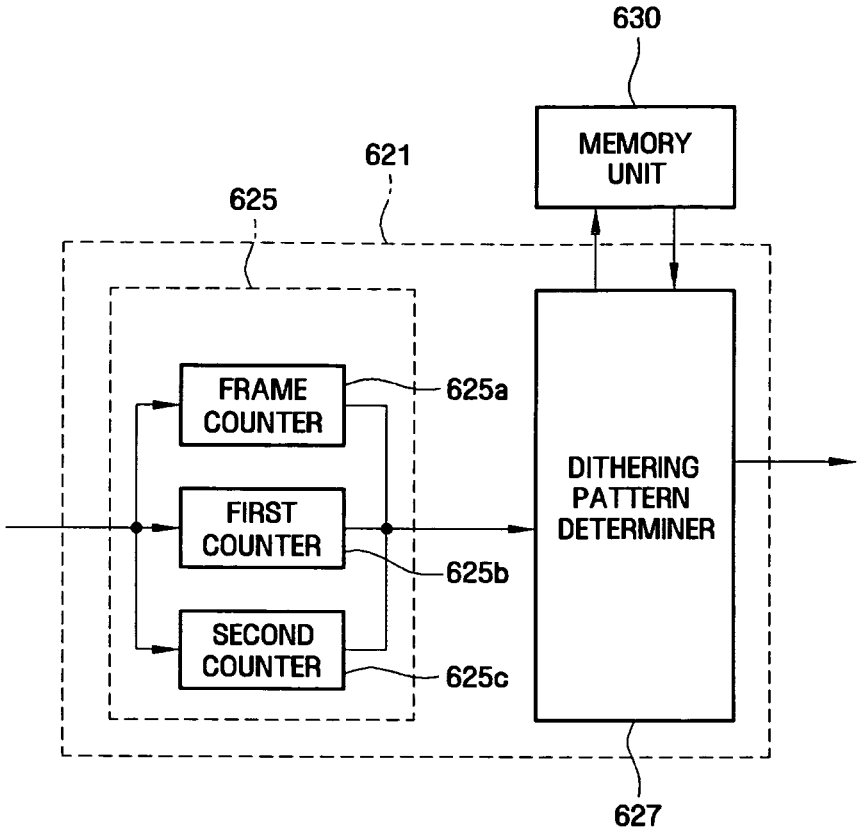
FIG. 6 is a block diagram of a dithering pattern selector shown in FIG. 5.
Figure 7A:
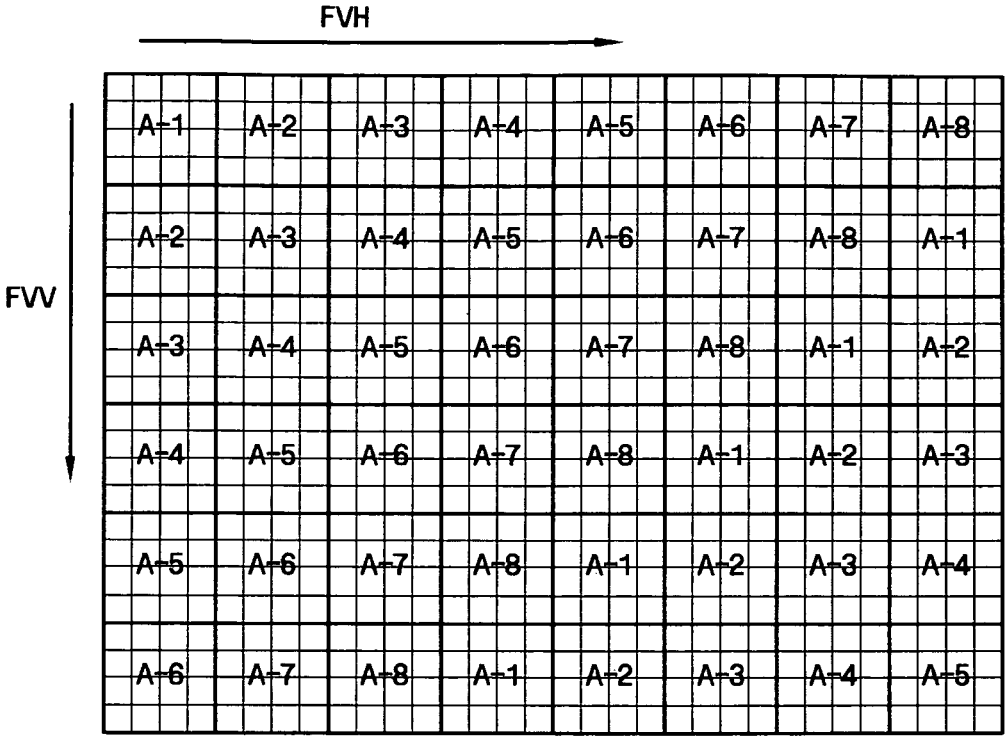
FIGS. 7*a* and 7*b* are diagrams of various dithering patterns that can be applied to the liquid crystal panel shown in FIG. 1.
Figure 7B:
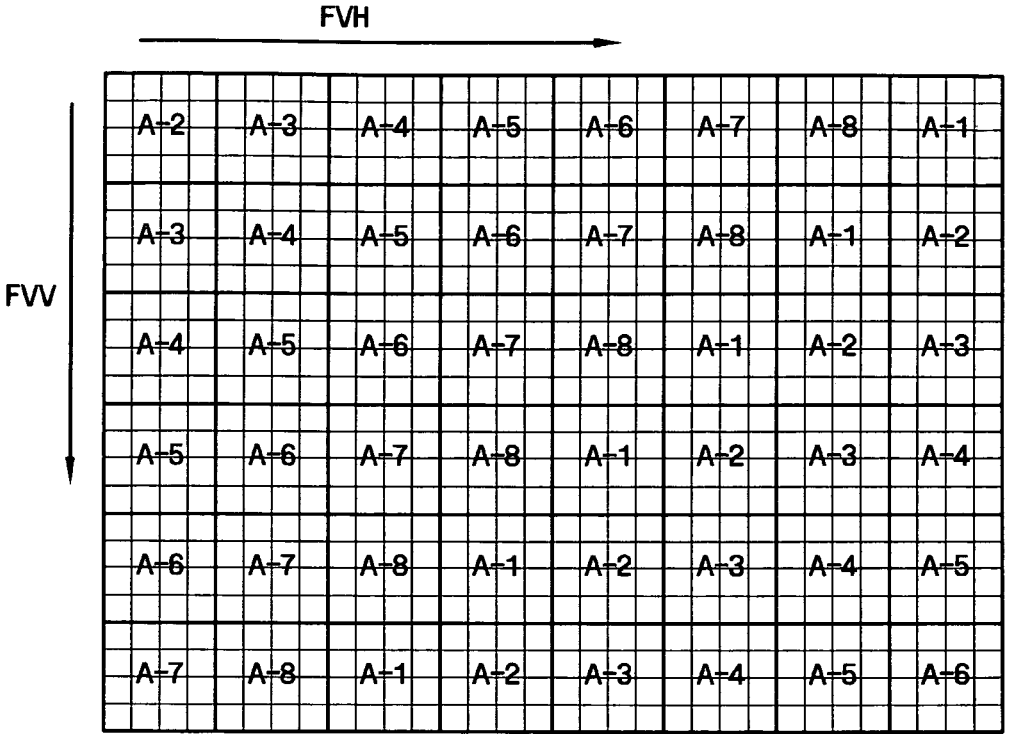

A liquid crystal display (LCD) and a method of driving the LCD according to exemplary embodiments of the present invention will hereinafter be described in detail with reference to FIGS. 1 through 6. FIG. 1 is a block diagram of an LCD 10 according to an exemplary embodiment of the present invention; FIG. 2 is an equivalent circuit diagram of a pixel of the LCD 10; FIG. 3 is a diagram for explaining the correspondence between a liquid crystal panel 300 shown in FIG. 1 and a dithering pattern array 800; FIG. 4 is a block diagram of a timing controller 600 shown in FIG. 1; FIG. 5 illustrates a block diagram of a dithering unit 620 shown in FIG. 4; FIG. 6 illustrates a block diagram of a dithering pattern selector 621 shown in FIG. 5; and FIGS. 7*a* and 7*b* are illustrate diagrams of various dithering patterns that can be applied to the liquid crystal panel 300.

Referring to FIGS. 1 and 2, the LCD 10 includes the liquid crystal panel 300, a gate driver 400 and a data driver 500, which are electrically connected to the liquid crystal panel 300, a gray-voltage generator 900, which is electrically connected to the data driver 500, a timing controller 600, which controls the gate driver 400, the data driver 500, and the gray-voltage generator 900, and a driving-voltage generator 700.

The liquid crystal panel 300 includes a plurality of pixels PX, which are electrically connected to a plurality of display signal lines and are arranged in a matrix. More specifically, the liquid crystal panel 300 is divided into a plurality of display regions, and each of the display regions may include a plurality of pixels PX. A plurality of dithering patterns may respectively correspond to the plurality of display regions. Each of the dithering patterns may be used to correct a primitive image signal for displaying an image in a corresponding display region, which will be described below in further detail with reference to FIG. 3.

The display signal lines include a plurality of gate lines $G_1$ through $G_n$, which transmit a gate signal, and a plurality of data lines $D_1$ through $D_m$, which transmit a data signal. The gate lines $G_1$ through $G_n$ extend in a first direction in parallel with one another, whereas the data lines $D_1$ through $D_m$ extend in a second direction in parallel with one another.

The gate driver 400 is provided with a gate-on voltage Von and a gate-off voltage Voff by the driving-voltage generator 700 and sequentially outputs the gate-on voltage Von and the gate-off voltage Voff to the gate lines $G_1$ through $G_n$ in response to a gate control signal CONT1 provided by the timing controller 600.

The data driver 500 receives a data control signal CONT2 and an image data DAT' from the timing controller 600, chooses a gray voltage from the gray-voltage generator 900 corresponding to the image data DAT', and provides the chosen gray voltage to the data lines $D_1$ through $D_m$. The gate control signal CONT1 is a signal for controlling the operation of the gate driver 400. Examples of the gate control signal CONT1 include a vertical initiation signal for initiating the operation of the gate driver 400, a gate clock signal for determining when to output the gate-on voltage Von, and an output enable signal for determining the pulse width of the gate-on voltage Von. The data control signal CONT2 is a signal for controlling the operation of the data driver 500. Examples of the data control signal CONT2 include a horizontal initiation signal for initiating the operation of the data driver 500, and an output instruction signal for providing instructions to output a data voltage.

The gray-voltage generator 900 may include a plurality of resistors (not shown), which are connected in series between a ground and a node to which a driving voltage AVDD is applied, and may thus generate a gray voltage by dividing the driving voltage AVDD using the plurality of resistors. Exemplary embodiments of the present invention are not restricted to this, however, and the gray-voltage generator 900 may be realized in various manners, other than that set forth herein.

The timing controller 600 receives a primitive image signal in the form of red (R)-green (G)-blue (B) signals and a plurality of external clock signals for controlling the display of the RGB signal from an external graphic controller (not shown). The primitive image signal is represented hereinafter as DAT. The external clock signals include a data enable signal DE, a vertical synchronization signal $V_{sync}$, a horizontal synchronization signal $H_{sync}$, and a main clock signal MCLK. The data enable signal DE maintains the RGB signal to have a high level during the input of the RGB signal to the timing controller 600, and thus enables the timing controller 600 to identify the RGB signal. The vertical synchronization signal $V_{sync}$ is a signal for indicating the beginning of a frame. The horizontal synchronization signal $H_{sync}$, is a signal for distinguishing the gate lines $G_1$ through $G_n$. The main clock signal MCLK is a clock signal with which all the signals necessary for driving the LCD 10 are synchronized.

The timing controller 600 receives the primitive image signal DAT for displaying an image on the liquid crystal panel 300, that is, the RGB signal, generates the image data DAT' corresponding to the RGB signal, and provides the image data DAT' to the data driver 500. In addition, the timing controller 600 generates internal clock signals, that is, the gate control signal CONT1 and the data control signal CONT2, based on the external clock signals $V_{sync}$, $H_{sync}$, MCLK, and DE.

As shown in FIG. 4, in order to provide the image data DAT' by using dithering, the timing controller 600 includes a grayscale determining unit 610, which analyzes a grayscale level corresponding to the primitive image signal and transmits grayscale information of each of the display regions of the liquid crystal panel 300 along with the primitive image signal, a dithering unit 620, which chooses a dithering pattern for each of the display regions of the liquid crystal panel 300 according to the grayscale information of each of the display regions of the liquid crystal panel 300 and corrects the primitive image signal using the chosen dithering patterns and outputs the image data DAT', and a memory unit 630, which stores a plurality of the dithering patterns.

Each of the pixels PX of the liquid crystal panel 300 may include a liquid crystal capacitor $C_{1c}$ and a storage capacitor $C_{st}$, as shown in FIG. 2. Referring to FIG. 2, the liquid crystal capacitor $C_{1c}$ may include a pixel electrode PE, which is formed on the first display panel 100, a common electrode CE, which is formed on the second display panel 200, and a liquid crystal layer 150, which is interposed between the first and second display panels 100 and 200. A color filter CF may be formed on the second display panel 200 and forms a part of the second display panel 200. A switching element Q is connected to an i-th gate line $G_i$ (where i is between 1 and n) and a j-th data line $D_j$ (where j is between 1 and m) and provides a data voltage to the liquid crystal capacitor $C_{lc}$. The storage capacitor $C_{st}$, however, is optional. Alternatively, the color filter CF may be formed on the first display panel 100 or alternatively, the common electrode CE may also be formed on the first display panel 100.

A common voltage Vcom, which is provided by the driving-voltage generator 700, is applied to the common electrode CE. A data voltage, which is provided by the data driver 500, is applied to the pixel electrode PE through the j-th data line $D_j$, as shown in the exemplary embodiment of FIG. 2. The liquid crystal capacitor $C_{lc}$ is charged with a voltage corresponding to the difference between the common voltage and the data voltage and can thus display an image.

The driving-voltage generator 700 may include, a gate-on/off voltage generator (not shown), and a common-voltage generator (not shown). The driving-voltage generator 700 generates the driving voltage AVDD, which is necessary for driving the LCD 10, and provides the driving voltage AVDD to the gray-voltage generator 900, the gate-on/off voltage generator (not shown) and the common-voltage generator (not shown).

The gray-voltage generator 900 is provided with the driving voltage AVDD by the driving-voltage generator 700 and generates a gray voltage.

The gray-voltage generator 900 may include a plurality of resistors (not shown), which are connected in series between a ground and a node to which the driving voltage AVDD is applied, and may thus generate a gray voltage by dividing the driving voltage AVDD. The present invention is not restricted to this, however, and the gray-voltage generator 900 may be realized in various manners, other than that set forth herein.

The correspondence between the liquid crystal panel 300 and the dithering pattern array 800, which is a "virtual" pattern, will hereinafter be described in detail with reference to FIG. 3.

Referring to FIG. 3, the liquid crystal panel 300 may be divided into a plurality of display regions, which are a×b matrices (where a and b are natural numbers). The display regions may have the same size as a plurality of dithering patterns. For example, if the dithering patterns are 4×4 matrices of dithering pixels, the display regions may be 4×4 matrices of pixels. The display regions may respectively correspond to the dithering patterns 810 on a pixel-by-pixel basis. It should be understood that there is only one physical panel 300, and that the dithering pattern array 800 is a virtual panel.

The display regions include a first display region 310 and a plurality of second display regions 320. each of the plurality of second display regions 320 adjoins one side of the first display region 310. A dithering pattern corresponding to the first display region 310 is different from a plurality of dithering patterns respectively corresponding to the second display regions 320. More specifically, if there are a first display region 310 and four second display regions 320, which adjoin the first display region 310 and are disposed on the upper, lower, left and right sides, respectively, of the first display region 310, a first dithering pattern 810 corresponding to the first display region 310 may differ from four second dithering patterns 820 in the virtual array 800 respectively corresponding to the four second display regions 320.

At least two of the four second dithering patterns 820 may differ from each other. For example, a second dithering pattern 820 that adjoins the upper side of the first dithering pattern 810 may be the same as a second dithering pattern 820 that adjoins the left side or right side of the first dithering pattern 810, and a second dithering pattern 820 that adjoins the lower side of the first dithering pattern 820 may be the same as a second dithering pattern 820 that adjoins whichever of the second dithering patterns 820 that adjoin the left and right sides, respectively, of the first dithering pattern 810 is not the same as the second dithering pattern 820 that adjoins the upper side of the first dithering pattern 810.

Referring to FIG. 4, as noted above the timing controller 600 includes the grayscale determining unit 610, the dithering unit 620, and the memory unit 630.

The liquid crystal panel 300 may be divided into a plurality of display regions, each including a plurality of pixels. The timing controller 600 can correct an input primitive image signal DAT using a plurality of dithering patterns respectively corresponding to the display regions of the liquid crystal panel 300, so as to produce the image data DAT'.

The grayscale determining unit 610 analyzes a grayscale level corresponding to the input primitive image signal DAT and transmits grayscale information of the input primitive image signal to the dithering unit 620 along with the input primitive image signal as signal DAT_C. The dithering unit 620 corrects the input primitive image signal DAT using a plurality of dithering patterns chosen according to the grayscale information provided by the grayscale determining unit 610. The memory unit 630 stores a plurality of dithering patterns and the identification values of the dithering patterns. Thus, it is possible to search the memory unit 630 for a desired dithering pattern by using an identification value generated by the dithering unit 620.

In other words, the dithering pattern array 800 is stored in the memory unit 630, the gray scale determining unit 610 receives the primitive image signal DAT outputs the image signal DAT_C including the gradation information to the dithering unit 620. The dithering unit 620 determines the dithering pattern corresponding to DAT_C among the dithering pattern array 800 stored in the memory unit 630 and dithers DAT_C using the determined dither pattern.

The memory unit 630 may store the plurality of dithering patterns in a lookup table, for example, an 8×8 lookup table having eight rows, which respectively present eight correction values that can be applied to the grayscale of each display region, for example, 1/8, 2/8, 3/8, 4/8, 5/8, 6/8, 7/8, and 8/8, and eight columns, which present eight dithering patterns for each of the eight correction values. That is, if a plurality of dithering patterns is provided for each of a plurality of correction values for the respective display regions of the liquid crystal panel 300, each of the correction values is set to n bits and m dithering patterns are applied to each of the correction values, the memory unit 630 may store a total of $2^n$×m dithering patterns. The $2^n$×m dithering patterns have their own identification values, which will be described below in detail. The memory unit 630 may store a plurality of dithering patterns in various manners, other than that set forth herein.

Referring to FIG. 5, the dithering unit 620 may include a dithering pattern selector 621 and a dithering processor 622. The dithering pattern selector 621 chooses a plurality of dithering patterns respectively corresponding to the display regions of the liquid crystal panel 300 in response to the image signal DAT_C, and the dithering processor 622 applies the chosen dithering patterns to the corresponding display regions of the liquid crystal panel 300 so as to effectively form a virtual dithering panel array represented at 800 in FIG. 3.

Referring to FIG. 6, the dithering pattern selector 621 may include a default value generator 625 and a dithering pattern determiner 627. The default value generator 625 includes a frame counter 625*a*, a first counter 625*b*, and a second counter 625*c*. The default value generator 625 generates a default value, and the dithering pattern determiner 627 determines a dithering pattern to be read from the memory unit 630 corresponding to the default value generated by the default value generator 625.

The default value generator 625 may generate a default value of a predetermined display region of the liquid crystal panel 300 by combining count values respectively provided by each of the frame counter 625*a*, the first counter 625*b*, and the second counter 625*c*. The dithering pattern determiner 627 searches for an identification value corresponding to the default value generated by the default value generator 625, searches the memory unit 630 for a dithering pattern corresponding to the detected identification value, and determines the detected dithering pattern as a dithering pattern for the predetermined display region.

More specifically, the frame counter 625*a* may count each frame, the first counter 625*b* may count the number of display regions subjected to dithering along a first direction, and the second counter 625*c* may count the number of display regions subjected to dithering along a second direction. The first and second directions may be row and column directions, respectively.

For example, if the frame counter 625*a*, the first counter 625*b*, and the second counter 625*c* are all 3-bit counters, the frame counter 625*a*, the first counter 625*b* and the second counter 625*c* may all be initially set to a value of '000'. The value of '000' may be set as a default value (FV) of a first display region in a first row of a first frame, and the first display region in the first row of the first frame may be designated as a reference display region of the first frame.

Once the dithering of the reference display region is complete, a display region next to the reference display region in the row direction, for example, a second display region in the first row of the first frame, may be subjected to dithering. In this exemplary embodiment, the first counter 625*b* may be set to a default value (FVH) of '001'. When an eighth display region on the right side of the reference display region is subjected to dithering, the first counter 625*b* may be set to a value of '111'. When a ninth display region in the first row of the first frame is subjected to dithering, the first counter 625*b* may be reset back to the value of '000', and the same dithering pattern as that applied to the reference display region may be applied to the ninth display region on the right side of the reference display region.

Once the dithering of all the display regions in the first row of the first frame is complete, a first display region in a second row of the first frame is subjected to dithering, and, thus, the second counter 625*c* may be set to a default value (FVV) of '001'. The display regions in the second row of the first frame may be sequentially dithered in the above-mentioned manner.

Once the dithering of all the display regions in the first frame is complete, a second frame is subjected to dithering, and the frame counter 625*a* is set to a value of '001'. A dithering pattern applied to a first display region in a first row of the second frame may be different from the dithering pattern applied to the reference display region of the first frame. For example, a dithering pattern applied to a display region on the right side or lower side of the reference display region of the first frame may be applied to the first display region in the first row of the second frame. In addition, the first display region in the first row of the second frame may be designated as a reference display region of the second frame, and the second frame may be subjected to dithering using the same method used to perform dithering on the first frame. As a result, the dithering pattern applied to the reference display region of the second frame may differ from the dithering pattern applied to the reference display region of the first frame.

In short, the default value generator 625 generates a default value (FV, FVH, FVV) based on the count values of the frame counter 625*a*, the first counter 625*b* and the second counter 625*c*, and then the dithering pattern determiner 627 searches for a dithering pattern corresponding to the default value. The dithering processor 622 then applies the identified dithering pattern to a corresponding display region.

FIGS. 7*a* and 7*b* represent examples of dithering patterns that can be produced by the dithering panel selector 621 of FIG. 5. As shown in FIG. 7*a*, the dithering value is shifted to the right, that is, FVH, in each successive row in the FVV directional. Similarly, in FIG. 7*b*, the dithering value is shifted to the right in the FVH direction as in FIG. 7*a*, except that a different reference start point A-2 is provided. In both FIGS. 7*a* and 7*b*, the first dithering pattern is different from the second dithering patterns and the four second dithering patterns are different based on their top/bottom, right/left side locations.

A method of driving an LCD according to an exemplary embodiment of the present invention will hereinafter be described in detail.

When a primitive image signal DAT for displaying an image in a plurality of display regions of the liquid crystal panel 300 is received at the timing controller 600, the grayscale determining unit 610 analyzes the grayscale value of the primitive image signal DAT and transmits an image signal DAT_C including grayscale information of the primitive image signal DAT to the dithering unit 620.

The dithering unit 620 generates a default value for each of the display regions, see FIGS. 7*a* and 7*b*, by combining the count values of the frame counter 625*a*, the first counter 625*b* and the second counter 625*c*. The generation of a default value has been described in detail hereinabove and, thus, a detailed description of the generation of a default value is not repeated.

A plurality of identification values respectively corresponding to the default values provided by the dithering unit 620 are determined, and then a plurality of dithering patterns respectively corresponding to the identification values are searched for from the memory unit 630. Thereafter, the identified dithering patterns are applied to the display regions as a dither processed image signal DAT', thereby correcting the primitive image signal DAT.

According to exemplary embodiments of the present invention, it is possible to prevent the occurrence of horizontal or vertical stripes or flickering by applying various dithering patterns to each frame so as to uniformly distribute dithering pixels over each frame. Therefore, it is possible to enhance the quality of display.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display comprising:

a liquid crystal panel divided into a plurality of display regions, each of the plurality of display regions having a plurality of pixels; and a timing controller receiving a primitive image signal for displaying an image in the display regions, and correcting the primitive image signal using a plurality of dithering patterns respectively corresponding to the plurality of display regions, wherein the timing controller comprises a dithering unit correcting the primitive image signal corresponding to the display regions; the dithering unit comprises a dithering pattern selector choosing the dithering patterns respectively corresponding to the display regions and a dithering processor applying the selected dithering patterns to the display regions; and the timing controller further comprises a memory unit storing the plurality of dithering patterns and a plurality of identification values that respectively identify the dithering patterns, wherein the dithering pattern selector comprises a default value generator generating a plurality of default values respectively corresponding to the display regions and a dithering pattern determiner determining the identification values respectively corresponding to the default values and applying the dithering patterns respectively corresponding to the determined identification values to the display regions, wherein ones of the plurality of display regions that are in contact with each other on at least one side in a same column correspond to different ones of the plurality of dithering patterns, wherein the display regions include a first display region and four second display regions contacting with upper, lower, left and right sides, respectively, of the first display region, and wherein the dithering pattern corresponding to the second display region on the upper side of the first display region is the same as one of the dithering patterns respectively corresponding to the second display regions on the right and left sides of the first display region, and the dithering pattern corresponding to the second display region on the lower side of the first display region is the same as the other of the dithering patterns respectively corresponding to the second display regions on the right and left sides of the first display region.

2. The liquid crystal display of claim 1, wherein:

the timing controller arbitrarily chooses one of the display regions as a reference display region for each frame of the primitive image signal, which is an image unit displayed on the liquid crystal panel and includes first and second frames; and when the second frame begins after the end of the first frame, the dithering pattern applied to the reference display region of the second frame is different from the dithering pattern applied to the reference display region of the first frame.

3. The liquid crystal display of claim 1, wherein the default value generator comprises a counter.

4. The liquid crystal display of claim 1, wherein the default value generator comprises a frame counter counting frames of the primitive image signal, a first counter counting a number of display regions subjected to dithering in a first direction, and a second counter counting a number of display regions subjected to dithering in a second direction, and the default value generator generates the default values by using the frame counter, the first counter and the second counter.

5. A liquid crystal display comprising:

a liquid crystal panel divided into a plurality of display regions that are arranged in a matrix having 'a' rows and 'b' columns, where a and b are natural numbers greater than one, wherein each row of the plurality of display regions comprises 'n' display regions, where n is a natural number greater than two, that are sequentially arranged in a first through n-th display region sequence, and wherein each column of the plurality of display regions comprises 'm' display regions, where m is a natural number greater than two; and a timing controller receiving a primitive image signal for displaying an image in the display regions, and correcting the primitive image signal using a plurality of dithering patterns respectively corresponding to the plurality of display regions, wherein the timing controller comprises a memory unit storing a plurality of dithering patterns and identification values that identify the dithering patterns; and a dithering pattern selector comprises a default value generator generating a plurality of default values respectively corresponding to the display regions and a dithering pattern determiner determining the identification value respectively corresponding to the default values and applying the dithering pattern respectively corresponding to the determined identification values to the display regions, wherein the timing controller sequentially determines the plurality of dithering patterns respectively corresponding to first through n-th display regions, and a dithering pattern corresponding to a k-th display region, where k is between 2 and n, in each of the 'a' rows is different from a dithering pattern corresponding to a (k−1)-th display region, wherein the dithering patterns respectively corresponding to at least two adjacent display regions in a same column are different from each other, wherein the display regions include a first display region and four second display regions contacting with upper, lower, left and right sides, respectively, of the first display region, and wherein the dithering pattern corresponding to the second display region on the upper side of the first display region is the same as one of the dithering patterns respectively corresponding to the second display regions on the right and left sides of the first display region, and the dithering pattern corresponding to the second display region on the lower side of the first display region is the same as the other of the dithering patterns respectively corresponding to the second display regions on the right and left sides of the first display region.

6. The liquid crystal display of claim 5, wherein the timing controller sequentially determines 'n' dithering patterns respectively corresponding to 'n' display regions in a q-th row, where q is a natural number between 1 and a, and then sequentially determines 'n' dithering patterns respectively corresponding to 'n' display regions in a (q+1)-th row.

7. The liquid crystal display of claim 5, wherein:

the timing controller comprises a dithering unit correcting the primitive image signal; and the dithering unit comprises a dithering pattern selector choosing the dithering patterns respectively corresponding to the display regions and a dithering processor applying the dithering patterns chosen by the dithering pattern selector to the display regions.

8. The liquid crystal display of claim 5, wherein:

the timing controller arbitrarily chooses one of the display regions as a reference display region for each frame of the primitive image signal, which is an image unit displayed on the liquid crystal panel and includes first and second frames; and when the second frame begins after the end of the first frame, the dithering pattern applied to the reference display region of the second frame is different from the dithering pattern applied to a reference display region of the first frame.

9. The liquid crystal display of claim 5, wherein the default value generator comprises a frame counter counting frames of the primitive image signal, a first counter counting a number of display regions subjected to dithering in a first direction, and a second counter counting a number of display regions subjected to dithering in a second direction, and generates the default values by using the frame counter, the first counter and the second counter.

10. A method of driving a liquid crystal display, the method comprising:

providing a liquid crystal panel divided into a plurality of display regions, each of the plurality of display regions having a plurality of pixels;

receiving a primitive image signal for displaying an image in the display regions;

generating a plurality of default values respectively corresponding to the display regions;

determining a plurality of identification values respectively corresponding to the default values; and correcting the primitive image signal by applying the dithering patterns respectively corresponding to the determined identification values to the display regions, wherein the display regions contacting with each other by at least one side in a same column correspond to different dithering patterns, wherein the display regions include a first display region and four second display regions contacting with upper, lower, left and right sides, respectively, of the first display region, and wherein the dithering pattern corresponding to the second display region on the upper side of the first display region is the same as one of the dithering patterns respectively corresponding to the second display regions on the right and left sides of the first display region, and the dithering pattern corresponding to the second display region on the lower side of the first display region is the same as the other of the dithering patterns respectively corresponding to the second display regions on the right and left sides of the first display region.

11. The method of claim 10, wherein the correcting of the primitive image signal comprises:

choosing one of the display regions as a reference display region for each frame, which is image unit displayed on the liquid crystal panel and includes first and second frames;

determining a number of dithering patterns respectively corresponding to a number of display regions adjacent the reference display region in a first or second direction; and applying the determined dithering patterns to the display regions adjacent to the reference display region in the first or second direction.

12. The method of claim 11, wherein the determining of the dithering patterns comprises:

storing a plurality of dithering patterns and identification values that identify the dithering patterns;

generating a plurality of default values respectively corresponding to the display regions;

determining a plurality of identification values respectively corresponding to the default values; and applying a plurality of dithering patterns respectively corresponding to the determined identification values to the display regions.

* * * * *